United States Patent [19]

Seger

[11] 3,993,385

[45] Nov. 23, 1976

[54] CURRENT COLLECTOR, PROVIDED WITH A SELECTOR, FOR A CONDUCTOR RAIL

[75] Inventor: Leif Sven Seger, Ruotsinpyhtaa, Finland

[73] Assignees: A. Ahlström Osakeyhtio; Oy Nokia AB, both of Finland

[22] Filed: Jan. 16, 1975

[21] Appl. No.: 541,604

[30] Foreign Application Priority Data

Jan. 31, 1974 Finland ..... 274/74

[52] U.S. Cl. ..... 339/21 R; 339/75 M

[51] Int. Cl.[2] ..... H01R 13/54

[58] Field of Search ..... 339/21, 22, 32, 33, 339/75 M; 240/52 R, 52 HT, 73 R, 73 QD

[56] References Cited

UNITED STATES PATENTS

| | | | |
|---|---|---|---|
| 3,613,045 | 10/1971 | Routh | 339/21 R |
| 3,646,501 | 2/1972 | Valtonen | 339/75 M |
| 3,686,614 | 8/1972 | Hyrylainen | 339/21 R |
| 3,718,886 | 2/1973 | Hoffmeister | 339/21 R |

*Primary Examiner*—Roy Lake
*Assistant Examiner*—Mark S. Bicks
*Attorney, Agent, or Firm*—Bucknam and Archer

[57] ABSTRACT

A current collector to be engaged with a conductor rail and specifically to desired conductors thereof, which collector comprises a box-like frame of an insulating material, in which at least three contact fingers are movably arranged so that at least two of said fingers may be brought simultaneously from a retracted position inside the frame to a position protruding from the frame to engage the conductors in the conductor rail, said fingers being operated by a camshaft member slidable in its axial direction and turnable around its axis and provided with cams to engage the fingers, the cams being so positioned that, at turning of the camshaft member, a desired pair of contact fingers, depending on the axial position of the camshaft member, is brought into contact with the corresponding conductors of the conductor rail. Preferably, the collector frame further comprises a turning lever connected to and allowing axial movement of the camshaft member.

5 Claims, 5 Drawing Figures

CURRENT COLLECTOR, PROVIDED WITH A SELECTOR, FOR A CONDUCTOR RAIL

BACKGROUND OF THE INVENTION

1. Field of the Invention

The present invention relates to a current collector, provided with a selector, for a conductor rail, a current collector which comprises a box-shaped frame to which at least three contact fingers have been attached so that they can move, at least two of the fingers at a time being transferrable, by means of a camshaft or a corresponding member, from a retracted position inside the frame to a position protruding from the frame to contact the conductors in the conductor rail.

2. Description of the Prior Art

The term conductor rail denotes a device which distributes electric current and comprises a box-like profile open on one side. Inside the profile there are conductors attached to insulation pieces, the conductors being exposed on a level vertical to the direction indicated by the said opening and the center of the profile so that current can be taken from the conductors through the said opening at an arbitrary point by means of a current collector positioned alongside the rail. Such conductor rails having more than two conductors can be coupled to the network in three phases or they can be coupled so that several coupling circuits are created. When current is received by the current collector from the network in one phase, the object is usually to distribute the load evenly between the various phases. For this reason it is important that the different current collectors can be coupled to the different phases by means of a selector. When the conductor rail is coupled in several coupling circuits it is, of course, important that the current collector, with the help of the selector, can be coupled without difficulty to the correct coupling circuit.

Previously known are current collectors provided with a selector, such as the current collectors according to Finnish published patent applications Nos. 47,236 and 47,237 and that according to German published patent application No. 2,215,451. The former two have a disadvantage in the large size of the current collectors, i.e., the current collectors protrude notably from the conductor rail. In addition, in them it is difficult to direct the contact fingers precisely so that they also contact the conductors properly as described in Finnish published patent application 45,711, a disadvantage which the latter device aims to eliminate. The current collector described in German published patent application No. 2,215,451, on the contrary, retracts almost completely inside the conductor rail. These current collectors provided with a selector have a disadvantage in that they are too easily coupled to any of the current circuits available in the conductor rail. Inadvertently, a layman can easily couple the current collector to a wrong circuit and thereby, for example, load the same phase with all the current collectors.

It is true that a current collector with a separate preselector of the coupling circuit or phase is known from German Pat. No. 2,060,262. This device, however, has a disadvantage in its large size. In the device all the contact fingers are coupled to a contact with the current conductors in the conductor rail. Thereby the creep paths in the current collector in a three-phase system must be dimensioned according to the voltage between the phases (e.g., 380 V). Current conductors in which only the contact fingers in use are in contact with the current collectors can in one-phase operation be dimensioned according to the voltage between the zero conductor and the phase conductor (e.g., 220 V).

The object of the present invention is to eliminate the above disadvantages and provide a current collector which protrudes relatively little from the conductor rail and which also has a coupling circuit preselector.

SUMMARY OF THE INVENTION

The present invention provides a current collector of the character once described, which comprises a box-like frame, preferably of an insulating material; at least three contact fingers movably arranged within said frame so that they can move between a retracted position inside the frame to a position protruding from the frame to bring the fingers in engagement with the conductors in the conductor rail; a camshaft member slidable in its axial direction in said frame and turnable around its axis; and cams on said camshaft member so positioned that, depending upon the axial position of the camshaft member, they engage a desired pair of contact fingers and, at turning of the camshaft member, move said pair of contact fingers into contact with corresponding conductors in the conductor rail.

The current collector according to the invention has an advantage in that, when the camshaft must be transferred in the axial direction to select the coupling circuit, the transfer can be arranged entirely separately from the rotatory movement of the camshaft. The word camshaft in this context denotes in general a member which produces a laterally directed effect when it is rotated. A suitable coupling circuit can be easily preselected for each current collector before it is positioned in the contact rail. If someone who does not know current collectors has to detach the current collector from the conductor rail, e.g., when seeking suitable lighting angles for advertisements, he need not wonder to which circuit the current collector in question has been coupled because it is automatically coupled to the same circuit.

DESCRIPTION OF THE PREFERRED EMBODIMENTS

Figure 1:
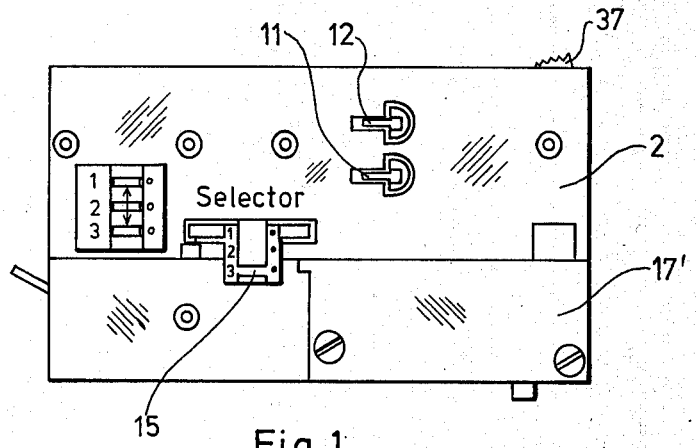
FIG. 1 shows a side view of a current collector according to the invention, with the contact fingers in the retracted position.
Figure 2:
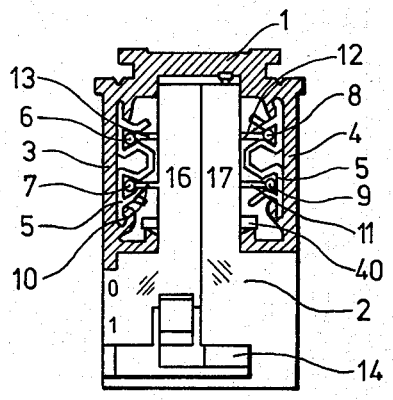
FIG. 2 shows an end view of a current collector placed in the conductor rail.

The current collector according to the invention illustrated in FIG. 1 is mainly meant for a conductor rail of the type shown in FIG. 2. The conductor rail shown in FIG. 2 comprises a metal supporting rail 1 which works as a supporting structure and which can be, for example, bar-pressed aluminum rail. The supporting rail has a U-shaped cross section and forms an open longitudinal groove for the current collector 2. Longitudinal insulation strips 5 have been attached to both side walls 3 and 4 of the supporting rail, and, for example, copper current conductors 6, 7, 8 and 9 have been set in the grooves in the insulation strips. The current collector 2 has four contact fingers 10, 11, 12, and 13, of which finger 10 with finger 11, 12 or 13 alternatively can, with turning lever 14, be brought into a position protruding from the frame of the current collector 2. Furthermore, the device has blade-like grippers 40 which keep the box attached to the rail 1. In FIG. 2 the fingers 10 and 11 are in the protruding position. By moving the prong 15 shown in FIG. 1 to position 1, 2, or 3, contact finger 13, 12, or 11 respectively together with finger 10 can be caused to transfer to the protruding position when the lever 14 is turned. Box part 17', which can be removed separately, covers the attaching screws of the current collector. FIG. 2 shows that the current collector 2 has two box halves, 16 and 17.

Figure 3:
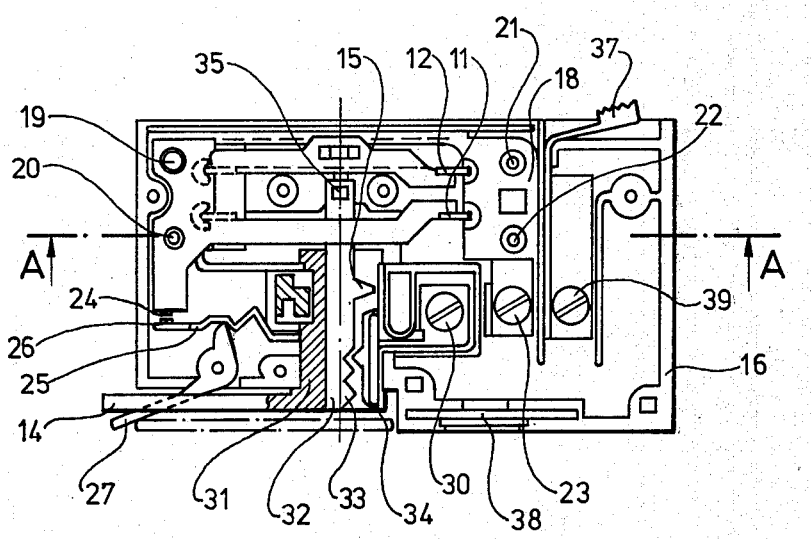
FIG. 3 shows a side view of a current collector with one box half removed.
Figure 4:
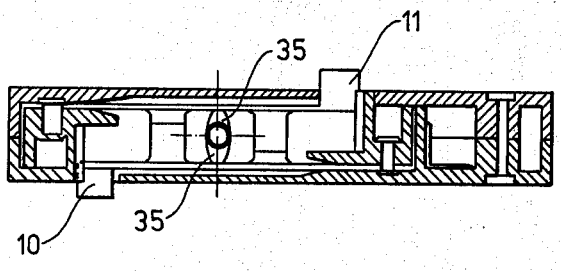
FIG. 4 shows a section along line A—A in FIG. 3 of a current collector.

FIG. 3 shows a side view of a current collector with the box half 17 and the box part 17' removed. The box has been made from an electrical insulating material. Inside the box there is also an intermediate part made from an insulating material; the arms of the contact fingers 11 and 12 have been attached to this part with pipe rivets 19, 20 and on the reverse side the arms of the contact fingers 13 and 10 with rivets 21 and 22. The contact fingers with their arms have been made from some suitable electrically conductive, resilient material, e.g., bronze. The contact fingers 11, 12 and 13 have been bent from one piece, the contact finger 10 being of a separate piece. There is a coupling screw 23 in the arm of the contact finger 10. The plate of the contact fingers 11, 12 and 13 has a contact stud 24 which corresponds to the contact stud 26 in the swing 25; the swing can be moved by means of a lever 27. At the other end of the swing there is a coupling screw 30. A sleeve 31 provided with a turning lever 14 has been attached with bearings in the opening in the box halves 16 and 17. The opening of the sleeve is angular in extent with respect to the sleeve 31 longitudinal axis and a camshaft 32, provided with the prong 15, has been fitted in it. The camshaft 32 turns, together with the sleeve 31, but it can be moved in its axial direction by means of a prong 15 which moves in a slit in the sleeve 31. The camshaft has teeth 33, into which retainer spring 34 (that is supported by sleeve 31) fits; this spring retains the axial movement of the camshaft in three different positions. On one side the camshaft has two cams 35 (one of the cams is covered by the arm of the contact finger 11), on the other side of the shaft there is one longer cam which moves the finger 10 and at one position of the prong 15 also the finger 12. The axial distance of the cams from each other and the axial length of the cam on the reverse side have been selected so that the cams can move one of the fingers 11, 12, or 13 only simultaneously with the finger 10. The turning sleeve 31 has been provided with a locking device 36 which prevents the turning of the sleeve unless the current collector has been pressed against the conductor rail. When the camshaft is rotated the prong 15 turns inside the box.

Figure 5:
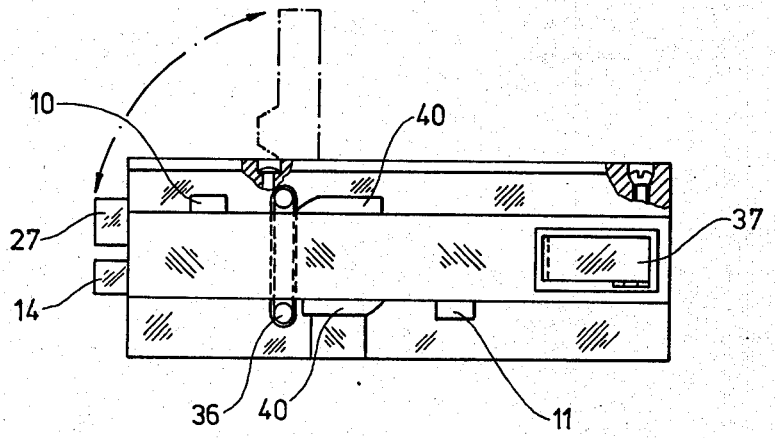
FIG. 5 shows a plan view of a current collector.

As will be appreciated by the artisan from the foregoing, the cams 35 on camshaft 32 have surfaces that are laid out both axially and in radial distance from the longitudinal axis of camshaft 32 such that for each distinct axial holding position determined by the teeth 33 and spring 34, a predetermined pair of contact fingers out of the group of contact fingers 10, 11, 12 and 13 will be extended when the lever 14 is turned to the full outline position shown in FIG. 5. The particular pair of contact fingers 10, 11, 12 and 13 which are extended in such case is therefore directly established by the axial position of camshaft 32, which can be shifted by pushing upon prong 15 until camshaft 32 shifts to the appropriate one of the teeth 33, in engagement with spring 34.

FIG. 3 shows that the current collector has a protective grounding contact 37 which touches the supporting structure of the conductor rail or a separate protective grounding conductor or when the current conductor is placed in the conductor rail.

The swing 25 seen in FIG. 3 works as a switch together with the lever 27. When the lever 27 is in the lower position the switch is coupled. The lever 27 in its lower position prevents the movement of the turning lever 14 of the sleeve 31, and thus the contact fingers cannot be moved when the current is coupled.

The current is received from the current collector by coupling the conductors of the cable which passes through the opening 38 to the coupling screws 23 and 30 and the grounding contact to the coupling screw 39 of the contact 37. The opening 38 is provided with a suitable threaded nipple to which, in a manner known per se, a lamp, for example, can be attached.

The figures and the description referring to them are meant only to illustrate the idea of the invention. In fact the embodiments of the invention can vary considerably within the claims.

What is claimed is:

1. A current collector for a conductor rail of the type having a plurality of separate longitudinally extending conductors, which current collector comprises a frame; at least three electrical contact fingers each supported on said frame for movement relative thereto between a retracted position out of engagement with a corresponding conductor of said rail, and a protruding position of engagement with said corresponding conductor; a camshaft member supported on said frame for axially slidable and rotary movement relative thereto; and cams on said camshaft member positioned to selectively engage respective contact fingers according to the axial position of the camshaft member and to move such contact fingers from their respective retracted positions to their respective protruding positions to engage corresponding conductors of said rail.

2. A current collector according to claim 1 including a lever connected to said camshaft member to rotate same, said lever being disposed to allow axial movement of the camshaft member relative to the frame.

3. A current collector according to claim 1 including notches in said camshaft member spaced apart from one another in the axial direction of the camshaft member, and a resilient member supported by said frame and positioned to engage said notches, one at a time, to retain the camshaft member in a corresponding selected axial position.

4. A current collector acccording to claim 1 including a prong on said camshaft member and extending therefrom to facilitate the axial movement thereof.

5. A current collector according to claim 4 wherein said prong is carried on the camshaft member so that when same is rotated to move said contact fingers in their protruding positions, the prong is in a concealed position within the frame.

* * * * *